US006702148B1

(12) United States Patent
McCombes

(10) Patent No.: US 6,702,148 B1
(45) Date of Patent: Mar. 9, 2004

(54) PAPER FEED ASSEMBLY

(75) Inventor: Donald R. McCombes, Laguna Beach, CA (US)

(73) Assignee: Addmaster Corporation, Monrovia, CA (US)

( * ) Notice: Subject to any disclaimer, the term of this patent is extended or adjusted under 35 U.S.C. 154(b) by 57 days.

(21) Appl. No.: 10/117,527

(22) Filed: Apr. 4, 2002

(51) Int. Cl.[7] ..... B65H 3/06

(52) U.S. Cl. ..... 221/109; 271/117; 271/118; 902/12; 902/15

(58) Field of Search ..... 271/109, 117, 271/118; 902/12, 15; B65H 3/06

(56) References Cited

U.S. PATENT DOCUMENTS 4,699,366 A * 10/1987 Kashimura et al. ..... 271/4.1

6,155,556 A * 12/2000 Lynch et al. ..... 271/117

FOREIGN PATENT DOCUMENTS

JP 2-62333 * 3/1990 ..... B65H/3/06

* cited by examiner

*Primary Examiner*—Donald P. Walsh
*Assistant Examiner*—Kenneth W Bower
(74) *Attorney, Agent, or Firm*—Christie, Parker & Hale, LLP

(57) ABSTRACT

A paper feed assembly is disclosed whereby a single driver is used to both engage a paper to be acted on, move or feed the paper to a pre-determined area, and then retract so that the paper may be acted on. The paper feed assembly according to the present invention comprises a motor, a cage, a gear train, and a roller arm. The paper feed assembly being design to permit the motor to rotate in a first and a second rotation and to engage or retract from the paper in response to the first or the second rotation.

20 Claims, 6 Drawing Sheets

PAPER FEED ASSEMBLY

The paper feed assembly discussed herein generally relates to an assembly that engages a paper to be printed, feeds the paper to a pre-determined print area, and retracts itself from the paper. More specifically, the paper feed assembly discussed herein performs the foregoing functions with a single driver device.

BACKGROUND

Laser printers, inkjet printers, and point of sale (POS) printers generally require gears, pulleys, rollers, and the like and a combination of motors and solenoid valves ("driver devices") to engage a paper to be printed, feed the paper to a pre-determined print area, and deliver the printed paper, after it has been printed on, to a tray or a stacking chute. The paper discussed herein, for example, can be a check, a deposit slip, or a withdrawal slip. The use of more than one driver device is generally disadvantage for several reasons including the requirement that the overall printer be sufficiently large to accommodate the additional driver device, the added manufacturing costs for including the additional driver device, the higher power consumption to the end user for running the additional driver device, and having additional moving parts which can fail.

POS printers for banking transactions in particular generally require duplicate reports for multiple parties. For example, in a typical banking transaction, a bank may need to print on a deposit slip for its own record and may need to print again on a journal tape or a receipt for a merchant for his or her record. Consequently, available POS printers generally require multiple driver devices for printing on the paper and different set of driver devices for printing on the journal tape. Examples of POS printers with multiple driver devices are described in U.S. Pat Nos. 4,944,620; 5,080,513; 5,294,204; and 5,399,038. The disclosures of these patents, are incorporated herein by reference as it set forth in full. While the POS printers described in these patents are somewhat compact, inexpensive, and highly reliable, they utilize multiple driver devices and may therefore be disadvantageous for the reasons discussed.

Referring specifically to the '513 patent, there is shown and described a two-driver device for engaging a paper and feeding the engaged paper to a pre-determined print area. The '513 patent discloses a solenoid 51 which comprises a pinch roller 46 and a feed roller 37. When the solenoid 51 is actuated by the printer circuitry, the actuation moves the pinch roller 46, via a lever 47, and engages the paper between the pinch roller 46 and the feed roller 37. Next, a stepper motor 38 is actuated to turn the feed roller 37. The feed roller, in turn, moves the paper that is engaged between it and the pinch roller 46 in a horizontal direction. The paper is moved to a desired print position for printing by the print head 55. After the paper reaches the desired print position, the pinch roller 46 retracts so that the paper can be advanced by a different drive mechanism in the vertical direction for printing on multiple lines. The solenoid 51 and the stepper motor 38 are two separate driver devices used by the '513 patent to engage the paper and feed the paper.

Accordingly, there remains a need for a paper feed assembly which uses a single driver to engage the paper to be printed, feed or move the paper to a certain position such as a print position, and then retract so that the paper can be advanced vertically by a different set of driver devices for printing on multiple lines. In addition, there is also a need for a paper feed assembly which uses a single driver to engage the paper that has been printed on and moves the printed paper into a tray or a holding chute so that the printer is available to perform a new transaction.

SUMMARY

According to the present invention, there is provided a paper feed assembly design that both engages a paper to be printed on and feeds the paper to a pre-determined position with a continuous rotation of a motor. Subsequent to feeding the paper, the paper feed assembly provided is also responsive to a continues reverse motor rotation and retracts from the paper so that the paper may be printed on by a print head or the like.

The paper feed assembly according to the present invention comprises a motor, a roller arm, a gear train, and an assembly frame; the roller arm further comprising a drive roller, a driven roller, and a belt interconnecting the two rollers; wherein the motor has a first rotation which corresponds to a first signal input and a second rotation which corresponds to a second signal input; wherein the roller arm has a first travel direction which corresponds to the motor first rotation and a second travel direction which corresponds to the motor second rotation, and wherein the assembly frame is configured for assembling the motor, the roller arm, and the gear train thereon.

The paper feed assembly according to the present invention may also be characterized by a cage and mounted to the cage are a roller arm, a motor having a motor rotation, and a gear train for transferring the motor rotation to the roller arm; the roller arm further comprising a drive roller, a driven roller and a belt, and wherein the two rollers and the belt are configured to rotate as a consequence of the motor rotation.

The paper feed assembly performs the engaging and feeding function by utilizing friction to rotate the roller arm and after the roller arm engages the paper, utilizing slippage between the roller arm and the roller to feed the paper via the belt or O-ring.

The invention also includes a method for utilizing the paper feed assembly. The method comprising integrating the paper feed assembly into a POS printer and then sending signals to the paper feed assembly to engage the paper and to feed the paper.

BRIEF DESCRIPTION OF THE DRAWINGS

These and other features and advantages of the present invention will become appreciated as the same becomes better understood with reference to the specification, claims and appended drawings wherein:

DETAILED DESCRIPTION

Figure 1:
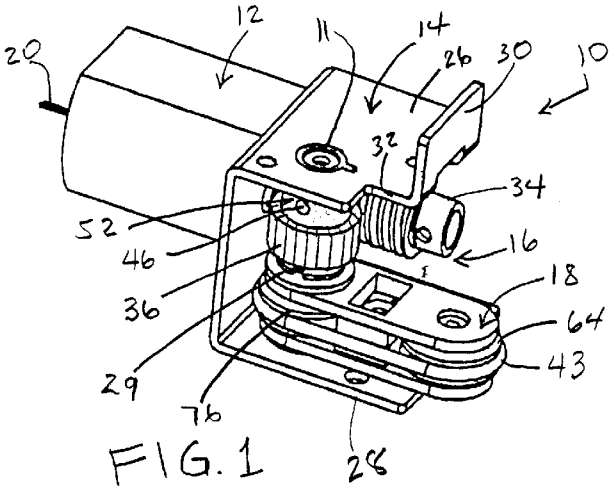
FIG. 1 is a semi-schematic perspective view of a paper feed assembly provided in accordance with practice of the present invention.
Figure 2:
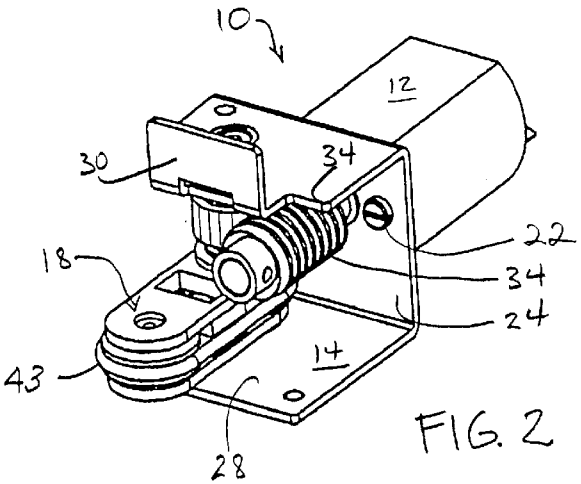
FIG. 2 is a semi-schematic perspective view of the paper feed assembly of FIG. 1 from a different perspective.

The detailed description set forth below in connection with the appended drawings is intended as a description of the presently preferred embodiments of the paper feed assembly in accordance with the present invention and is not intended to represent the only forms in which the present invention may be constructed or utilized. The description sets forth the features and the steps for constructing and using the paper feed assembly of the present invention in connection with the illustrated embodiments. It is to be understood, however, that the same or equivalent functions and structures may be accomplished by different embodiments that are also intended to be encompassed within the spirit and scope of the invention. Also, as denoted elsewhere herein, like element numbers are intended to indicate like or similar elements or features.

Referring now to FIGS. 1–4, there is shown and described an exemplary paper feed assembly in accordance with practice of the present invention, which is generally designated 10. The paper feed assembly shown therein comprises a motor 12, an assembly frame or cage 14, a gear train 16, and a roller arm 18, which are also collectively referred to herein as "components".

Figure 3:
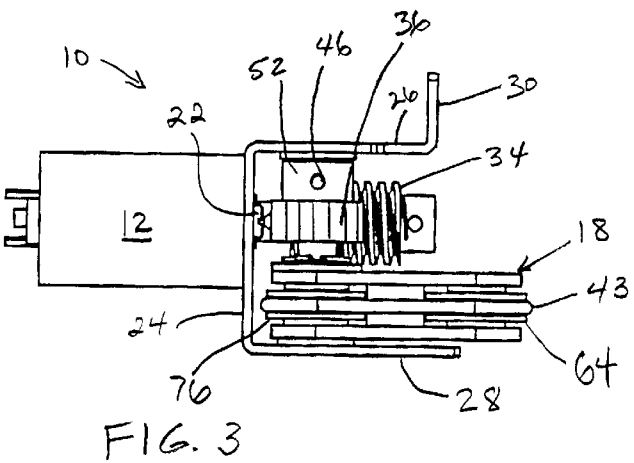
FIG. 3 is a semi-schematic side elevation view of the paper feed assembly of FIG. 1.
Figure 4:
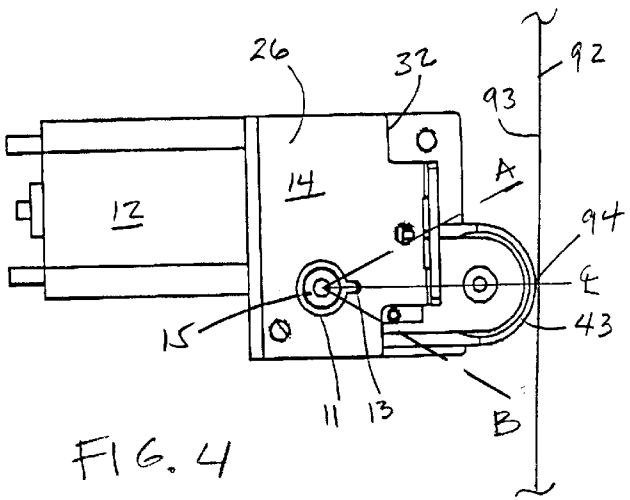
FIG. 4 is a semi-schematic top plan view of the paper feed assembly of FIG. 1.
Figure 8:
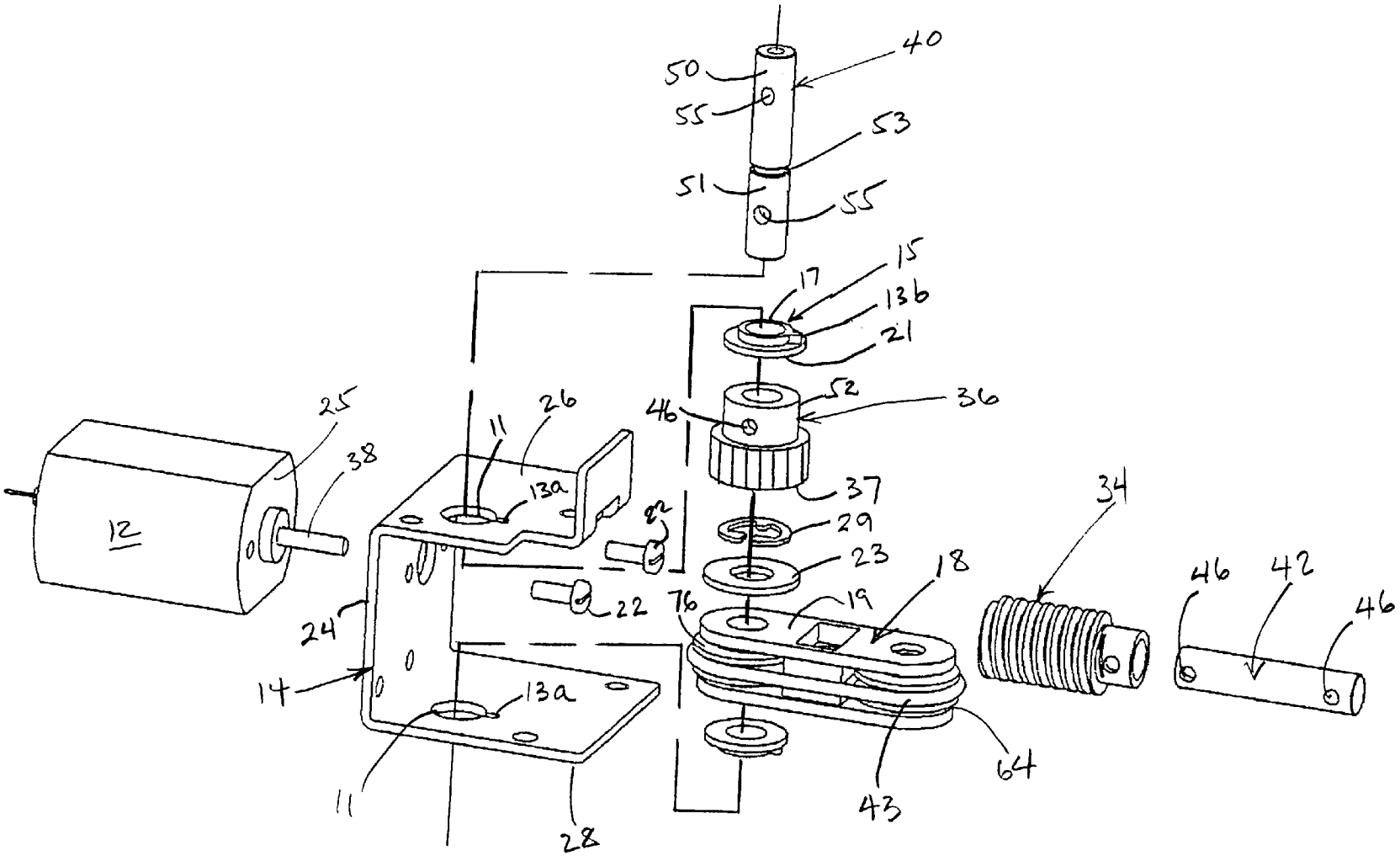
FIG. 8 is an exemplary exploded view of the paper feed assembly of FIG. 1.

The motor 12 shown is a conventional DC motor, which may alternatively be a stepper motor, and comprises a power line 20 connected on one end to the armature (inside of the motor) and on the other end to a Berg connector (not shown) or the like. The Berg connector is attachable to a drive circuit and is capable of receiving signals from the drive circuit and relating the same to the armature. Depending on the signals received from the drive circuit, the motor can be made to rotate in a first direction, a second direction, or not rotate. In an exemplary embodiment, the first direction may generally correspond to a first signal (such as a first polarity), the second direction may generally correspond to a second signal (or a second polarity), and no rotation may generally correspond to no signal. Additionally, the motor may be regulated by varying the voltage applied to the motor 12 to control the speed of the motor rotation. The motor 12 may be mounted on to the cage 14 by conventional means such as by fastening a pair of screws 22 through the back wall 24 of the cage into the motor front flange 25 (FIGS. 3, 4, and 8).

The cage 14, in accordance with practice of the present invention, is constructed from a steel plate such as from stainless steel or black steel with a nickel or a chrome finish. The cage resembles a C-channel (FIG. 3) and, accordingly, comprises a top wall 26, a bottom wall 28, and a back wall 24. The cage 14 may also include other functional surfaces, such as a top mounting surface or flange 30 for mounting an ink overflow reservoir (not shown) and/or cutouts 32, 34 (FIGS. 1, 2, and 4) for providing access to the various components mounted therein. As further discussed below, the cutouts 32, 34 and other apertures located on the cage 14 can be used to anchor or fix the various components to the cage. In an exemplary embodiment, the cage can be fabricated from 11 gauge to 20 gauge steel, and where necessary, from about ⅛" to 3⁄16" thick plates.

In an exemplary embodiment, the motor shaft 38 is configured to rotate the roller arm 18, which is connected to the wormgear shaft 40 via the gear train 16. The motor shaft 38 and the wormgear shaft 40 (FIG. 8) are orientated 90° from each other. The gear train 16, which comprises a worm 33 and a wormgear 36, is therefore selected because it provides the means for connecting nonintersecting shafts 38, 40 that are at a 90° angle with respect to each and provides large speed reduction between the input and the output speeds. In other words, the motor shaft rotation can greatly be reduced at the output shaft by the particular selection of the worm 33 and the wormgear 36. As readily understood, the size and the gear ratio of the gear train 16 depends on the desired motor speed reduction. In an exemplary embodiment, the motor 12 is rated for 7200 rpm. The worm 33 is a single threaded worm and has a velocity ratio of 1:20 with the wormgear. Thus, for every 20 revolutions of the worm (which has the same revolutions as the motor), the wormgear will rotate once. Other gear ratios, gear selections, and motor type and speed can be integrated with the paper feed assembly 10 and are therefore contemplated to fall within the scope of the present invention.

The present embodiment contemplates a number of gear train materials including steel and plastic, and (if the shafts are orientated differently, such as parallel to one another) a number of gear types. In an exemplary embodiment, the worm 33 and worm gear 36 are both made from plastic and have hollow cores. The hollow cores allow the worm and the wormgear to be mounted over a sleeve or a shaft. For example, the hollow core on the worm 33 allows it to telescopically and removeably secure to a worm sleeve 42 by its distal end 44 and by a set screw 46. The wormgear sleeve 42 is removeably attachable to the motor shaft 38 at the proximal end 48 of the sleeve by another set screw 46 (FIG. 8). In a similar fashion, the wormgear 36 is configured to telescopically and removeably secure to the wormgear shaft 40 by fastening a set screw 46 to the upper exterior section 52 of the wormgear directly to the wormgear shaft 40.

Figure 5:
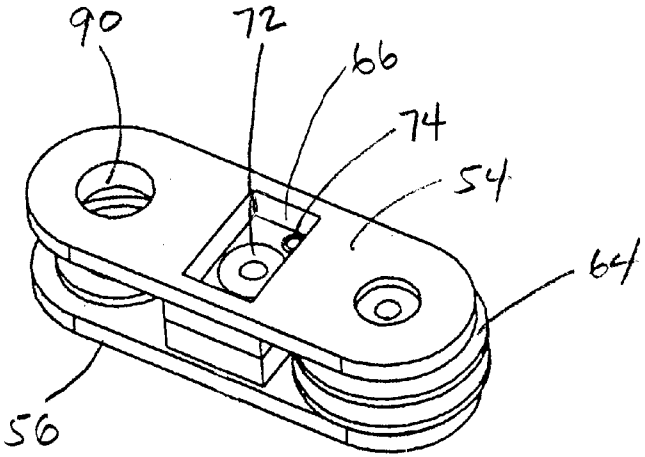
FIG. 5 is a semi-schematic perspective view of a roller arm of FIG. 1 provided in accordance with practice of the present invention.
Figure 7:
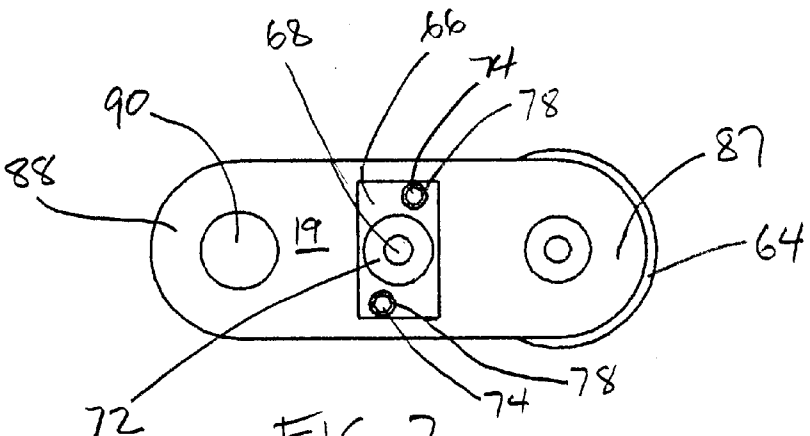
FIG. 7 is a semi-schematic top plan view of the roller arm of FIG. 5.
Figure 6:
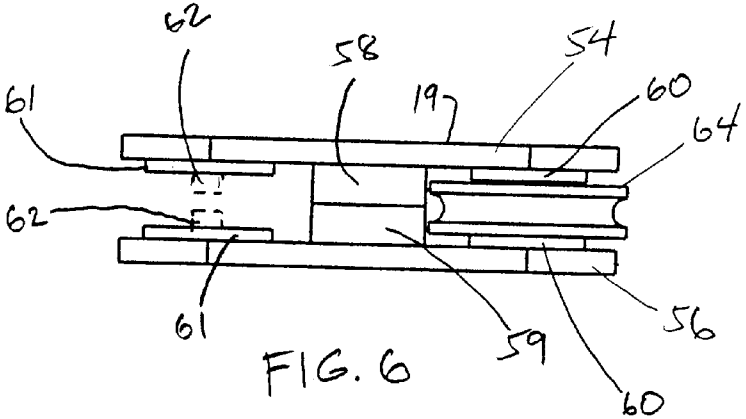
FIG. 6 is a semi-schematic side elevation view of the roller arm of FIG. 5.
Figure 9:
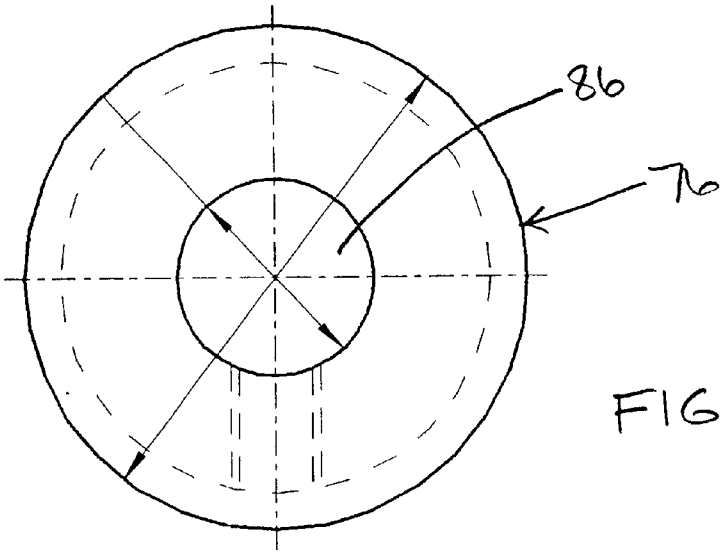
FIG. 9 is a semi-schematic top plan view of an exemplary roller provided in accordance with practice of the present invention.
Figure 10:
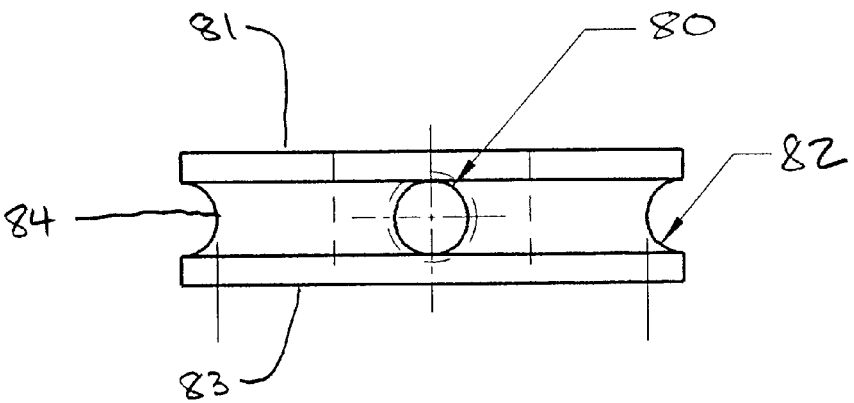
FIG. 10 is a semi-schematic side elevation view of the roller of FIG. 9.

Referring now to FIGS. 5–7, there is shown and described a roller arm 18 and a roller 64 in accordance with practice of the present invention. In an exemplary embodiment, the roller arm 18 is made from plastic injection molding or equivalent methods. The roller arm 18 generally comprises an upper roller arm half 54 and an almost identical lower roller arm half 56. Both are almost identical in that they both comprise union members 58, 59 and a pair of roller seats 60, 61. On each seat 60 or 61, there is also a short stem 62. As further discussed below, when the upper and the lower arm halves 54, 56 are joined or mated in the fashion shown in FIGS. 5–7, the short stems 62 from each of the upper and the lower arm halves 54, 56 interact to provide an axis of rotation. The roller 64, which has an annular bore and is adapted to receive the conjoining stems 62, rotates about the axis provided by the conjoining stems. In an exemplary embodiment, the conjoining stems 62 do not contact when the upper and the lower arm halves 54, 56 are joined together. However, the stems may easily be modified to do so. Although the roller arm 18 is shown with one roller 64, it is understood that the invention is preferably practiced with two rollers. The second roller, as further discussed below in connection with FIGS. 9 and 10, is mountable to the roller arm 18 in a slightly modified fashion as compared to the first roller 64. Thus, the short stems 62 shown on the seats 61 are shown to describe the way the first roller 64 is assembled only and not necessarily the way the second roller is assembled.

As best seen in FIGS. 5 and 7, the mid-section of the upper roller arm half 54 comprises a well 66 and an aperture 68 centrally located thereon. The aperture 68 defines a passage that extends from the surface of the well 66 to the surface of the union member 58. Thus, when the two roller arm halves 54, 56 are mated as shown in FIGS. 5–7, the two passages from the two roller arm halves 54, 56 align to provide a passage which extends from the well 66 of one arm half 54 to the well 66 of the other arm half 56. This passage in turn enables a rivet or a fastener 72 to be used to secure the two arm halves 54, 56 together. Alternatively, the present embodiment contemplates using plastic welding or glue to join the two halves together. If so, the aperture 68 and the passage may be eliminated altogether.

Referring again to FIG. 7, at the well 66, there is shown and described a pair of alignment bosses 74. The alignment bosses 74 are formed on the upper surface of the union member 59 of the lower roller arm half 56. In a corresponding location, a pair of holes 78 are provided in the union member 58 of the upper roller arm half 54. The union between the alignment bosses 74 and the pair of holes 78 facilitate the alignment of the upper and the lower arm halves 54, 56. The two roller arm halves 54, 56 are therefore understood to be fastened together by a fastener or a rivet 72 only after the alignment between the alignment bosses and the pair of holes 78 has been performed. It is further understood that other alignment methods may be implemented with the present embodiment including providing a single alignment boss, a combination of an alignment boss and a detent engagement at the perimeter of the two arms, etc.

Referring now to FIG. 8, there is shown an exemplary exploded view of the paper feed assembly 10 in accordance with practice of the present invention. For purposes of clarity, the wormgear 36, wormgear shaft 40 and related components are shown relocated adjacent the cage 14. As shown in FIG. 8, the shaft 40 comprises an upper gear section 50 and a lower roller section 51. Disposed in between the two sections 50, 51 is a clip race 53, and on either side of the clip race are dimples 55, which may alternatively be tapped holes for receiving set screws. The upper gear section 50 is configured to receive the wormgear 36 and the lower roller section 51 is configured to receive the roller arm 18. Both the wormgear 36 and the roller arm 18 (more specifically, the roller 76 on the roller arm) are secured to the wormgear shaft 40 by set screws 46, which are configured to seat against the dimples 55. Further disclosure regarding how the roller arm 18 fastens to the wormgear shaft 40 is discussed below in connection with FIGS. 9 and 10.

Once the wormgear 36 and the roller arm 18 are fastened to the shaft, there is a gap between the gear top surface 37 and the roller arm surface 19 of the upper roller arm half 54 (FIGS. 1 and 3). In an exemplary embodiment, this gap is taken up by a flat washer 23 by sliding the washer onto the wormgear shaft 40 before either one of the wormgear 36 or the roller arm 18 is secured to the shaft. In an exemplary embodiment, the gap is further taken up by a spring clip or a spring washer 29. The spring clip 29 is configured to removeably slide into the clip race 53 located on the wormgear shaft 40. Once slidingly engaged thereon, the spring clip 29 exerts a resilient force on the washer 23 which in turn exerts a force on the roller arm surface 19 (as best seen in FIG. 1).

Still referring to FIG. 8, the cage 14 shown comprises a bearing receptacle 11 located on each of the top wall 26 and the bottom wall 28. The bearing receptacle 11 resembles a circular aperture with a tear drop 13*a* formed along the circumference of the circular aperture. In an exemplary embodiment, the bearing receptacles 11 are configured to receive a pair of bearings 15 that are located on each end of the wormgear shaft 40. The interactions between the receptacles 11 and the bearings 15 are means by which the wormgear shaft 40 is secured to the cage 14 and rotate. Each bearing 15 comprises an upper bearing part 17, which resembles a male counterpart of the receptacle 11, and a lower bearing part 21, which resembles a flat washer. The bearings 15 can be manufactured from a number of materials including metal and plastic. In an exemplary embodiment, the bearings 15 are made from plastic injection molding.

The various, components are preferably installed in the following manner: First, the motor is mounted to the cage. Next, the worm sleeve 42 is mounted to the motor shaft 38 and the worm 34 to the worm sleeve 42. The wormgear train is then installed by first assembling the upper and lower bearings 15 onto the cage 14 by inserting them into the receptacles 11 and aligning the tear drops 13*a*, 13*b*. Next, the shaft 40 is inserted in through the upper bearing 15 and the upper receptacle 11 while concurrently holding the wormgear 36 in line with the shaft 40. The shaft 40 then is inserted through the hollow core of the wormgear 36 and then through the washer 23. In the same manner, the shaft 40 is inserted through the roller arm 18 (via the roller 76 annular bore and the drive bore 90, as further discussed below), the lower bearing 15, and lower receptacle 11. The spring clip 29 is then inserted into the clip race 53 located on the wormgear shaft 40. Finally, a pair of set screws 46 are used to tighten the wormgear 36 and the drive roller 76 (further discussed below) against the dimples 55 located on the shaft. Once tightened by the set screws 46, the wormgear 36, the drive roller 76, and the shaft 40 may rotate together as a single unit. It will be appreciated by a person of ordinary skill in the art that the order of assembly discussed can vary and still produce the same outcome.

Referring now to FIGS. 9 and 10, there is shown and described a roller 76 in accordance with practice of the present invention. In an exemplary embodiment, the roller is made from a metal such as brass, copper, bronze, or an alloy. The roller 76 is identical to the roller 64 discussed with reference to FIGS. 5 and 6 with one exception, it has a threaded bore as compared to the roller 64 previously discussed. For identification purposes, the present roller will be referred to as the drive roller 76 and the roller 64 previously discussed the driven roller. The drive roller 76 comprises a threaded bore 80 located on the roller race 82 and extends from the center groove 84 on the roller race to the annular bore 86. The driver roller 76 also has an upper roller surface 81 and a lower roller surface 83. In an exemplary embodiment, the roller has a 0.41 inch outside diameter, a 0.187 inch annular bore, and a roller race with a radius of 0.035 inch. However, depending on the environment and the space in which the paper feed assembly 10 will operate in, different dimensions may be used. The center groove 84 is configured to receive a standard O-ring or belt 43, such as one made from neoprene, polyurethane, or ethylene propylene.

As previously alluded to, the drive roller 76 and the driven roller 64 is also different in the way each is mounted to the roller arm 18. In an exemplary embodiment, the driven roller 64 is rotatably mounted to the roller arm 18 and is rotatable about the axis of rotation formed by the conjoining short stems 62, as previously discussed. However, the drive roller 76, does not rotate about the axis formed by the conjoining short stems 62. Instead, the drive roller 76 is removeably secured to the wormgear shaft 40 by a set screw 46 and is rotatable with the wormgear shaft 40 by the securement of the set screw 46.

Referring again to FIGS. 6 and 7 in addition to FIGS. 8–10, the roller seats 61 on the drive end 88 of the roller arm 18, which is the left end of the roller arm 18 when viewed from the perspective of FIG. 7, are preferably flat. That is, there are no short stems 62 on any of the roller seats 61 on the drive end 88, only on the driven end 87. Thus, when the drive roller 76 is installed in the roller arm 18, the drive roller simply seats between the two roller seats 61 without the short stems 62. In addition, the drive end 88 comprises a drive bore 90 disposed on each of the upper and the lower roller arm halves 54, 56. Thus, when the drive roller 76 is slid in between the seats 61 (FIG. 6) and the annular bore 86 on the roller is aligned with the drive bore 90, there is a passage which is configured to receive the wormgear shaft 40.

With specific reference to FIG. 8, after the drive roller 76 is positioned between the seats 61 located on the roller arm 18 and the bores 86, 90 are aligned, the wormgear shaft 40 is then placed through the aligned bores. The drive roller 76 may then be removeably secured to the shaft by tightening a set screw 46 through the threaded bore 80 located in the roller race. It is understood that the O-ring must be placed over the drive roller 76 and the wormgear 40 passed therebetween before the wormgear shaft is positioned onto the cage. Also, as discussed with reference to FIG. 8 and to the way the components are assembled to the cage 14, the drive roller 76 is preferably not fastened to the shaft 40 until after the assembly of the wormgear train to the cage.

An exemplary operation of the paper feed assembly within a POS printer is now discussed with reference to FIGS. 11–14. However, before discussing the operation of the paper feed assembly 10 within this exemplary environment, its general operation will be discussed separate from the exemplary environment.

The general operation of the paper feed assembly 10 is best understood by referring again to FIGS. 1–4. The paper feed assembly generally has two positions, an engaged position and a retracted position. When there is no paper to engage or feed, the roller arm 18 normally sits in a retracted position. Conversely, when there is paper to engage or feed, the roller arm sits in an engaged position, which is the position the roller arm 18 contacts another surface, such as the surface 92 shown in FIG. 4. In the position shown in FIG. 4, the roller arm 10 is rotated so that the O-ring 43 touches the wall 92 at contact point 94. This engaged position is also represented by the centerline (CL) shown of the two axes of rotation being in the perpendicular position and touching the wall 92. The wall 92 shown in FIG. 4 is representative of a portion of a chute or a print guide on the POS printer in which a form, a check, or a deposit slip 93 may be positioned against for printing. The retracted position is a position, which may be characterized by the roller arm 18 being spaced apart from the contact surface. In FIG. 4, the retracted position can be a position wherein the centerline (CL) of the roller arm 18 is moved toward approximately the region designated as A or as B away from the wall 92.

The way in which the paper 93 is engaged and is fed or moved to a ready position such as a print position will now be discussed. Assuming that the roller arm 18 is originally in a retracted position somewhere near region A, once the paper 93 is placed into a print chute and against the wall 92, the roller arm 18 moves to engage the paper. This engagement is performed by energizing the motor 12 with a first signal sent from a drive circuit. This first signal causes the motor shaft 38 and the worm 33 to rotate in a first rotation. The worm 33 then causes the wormgear 36 to turn. Because the wormgear 36 is connected to the wormgear shaft 40 which is connected to the drive roller 76, the drive roller and the wormgear shaft also rotate in the first rotation.

As the drive roller 76 rotates in the first rotation, the friction between (1) the upper roller arm half 54 and the upper roller surface 81 and (2) the lower roller arm half 56 and the lower roller surface 83 causes the roller arm 18 to turn with the drive roller. The roller arm 18 turns until it contacts the wall 92 (FIG. 4) and engages the paper 93 with the O-ring 43. At this point, the roller arm 18 is prevented from further rotating due to the contact with the wall 92 by the O-ring or belt 43. The O-ring 43 therefore cushions the roller 64 and grips the paper 93.

Although the roller arm 18 is prevented from further rotating, the drive roller 76 continues to rotate due to the rotation of the wormgear shaft 40, the worm 33, and the motor shaft 38, which continue to rotate in response to the first signal from the drive circuit. Because of the continued rotation, the friction between (1) the upper roller arm half 54 and the upper roller surface 81 and (2) the lower roller arm half 56 and the lower roller surface 83 is overcome. In other words, shortly after the contact between the O-ring 43, the paper 93, and the wall 92, the drive roller 76 continues to rotate independent of the roller arm 18 due to a slippage between the drive roller 76 and the roller arm. This continued rotation causes the attached O-ring 43 to turn because of its contact with the drive roller 76. The O-ring 43 then transfers its rotational energy to the driven roller 64 and causes the driven roller 64 to also rotate.

The turning O-ring 43, which is in contact with the paper 93, causes the paper to move in response to the O-ring. In the exemplary embodiment shown in FIG. 4, the paper moves from the region A towards the region B. The paper 93 continues to feed until the motor 12 is de-energized and stops turning. If, for example, the paper feed assembly 10 is part of a POS printer, the paper 93 would be allowed to move or feed until it reaches a desired position such as a print position.

The roller arm 18 can now move to its retracted position located somewhere near region A, i.e., its starting position. This may be performed by sending a second signal to the motor 12. This second signal causes the motor to turn in a second rotation, which is preferably opposite the first rotation, in the manner previously discussed. After the roller arm 18 moves to the retracted position, such as somewhere near region A, the motor 12 is de-energized and the roller arm 18 is allowed to stop.

The process can be repeated by sending a third signal, which may be the same as the first signal or a new signal. For instance, after the paper 93 has been printed on, the roller arm 18 can again engage the paper and can feed the paper further in the direction of region B. This may be implemented to feed or advance the printed paper from the print area so that the POS printer is available for a new transaction. It is understood that if the original retracted position is somewhere near region B, then the process and the rotation are reversed.

Figure 13:
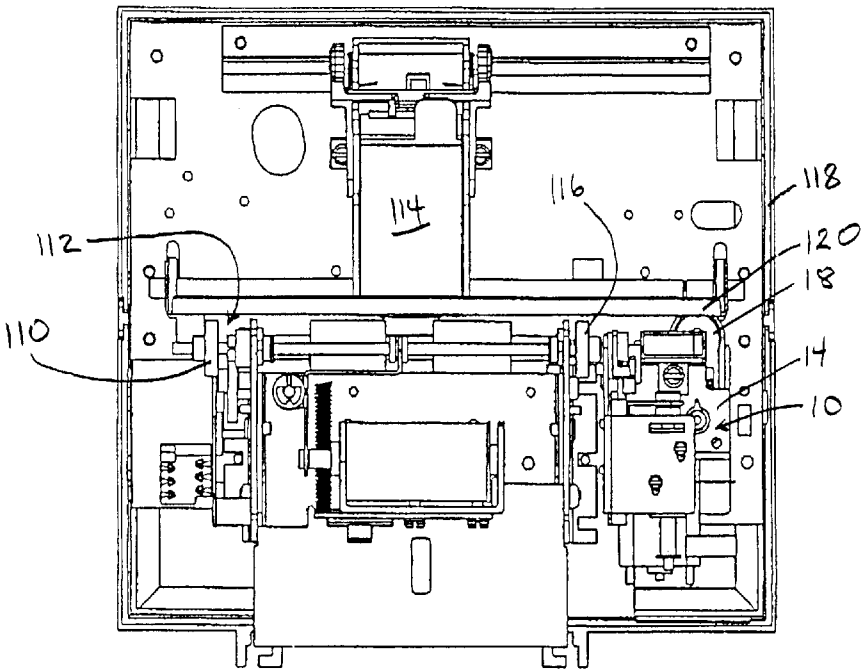
FIG. 13 is a semi-schematic top plan view of the printer of FIG. 11 with the covered removed.
Figure 11:
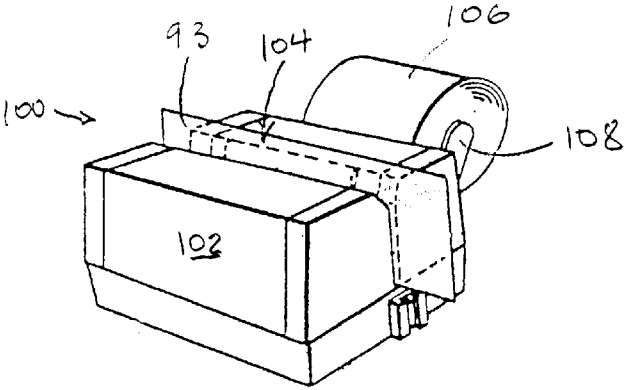
FIG. 11 is a semi-schematic perspective view of a conventional POS printer.
Figure 12:
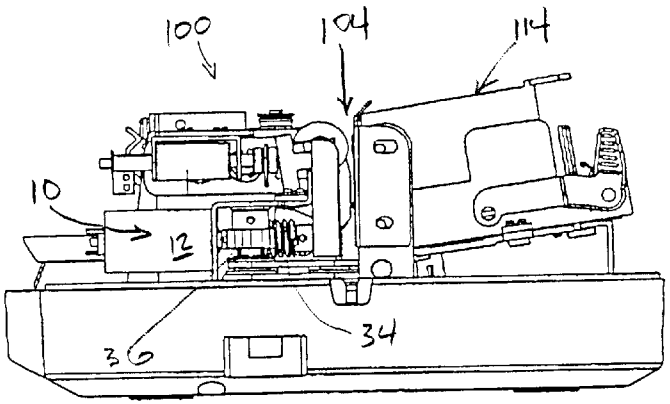
FIG. 12 is a semi-schematic side elevation view of the printer of FIG. 11 with the cover removed.

Referring now to FIGS. 11–14, there is shown an exemplary use or environment for the paper feed assembly 10 in accordance with practice of the present invention. The exemplary environment shown is a POS printer 100 for banking transactions. FIG. 11 depicts the POS printer with its cover 102 in place, a paper 93 positioned within a print chute 104, and a journal tape 106 loaded onto a tape post 108. FIGS. 12 and 13 depict the same POS printer with the cover 102 removed and with the paper feed assembly 10 installed. The POS printer 100 shown in FIGS. 11–13 is similar to the POS printers described in U.S. Pat. Nos. 4,944,620; 5,080,513; 5,294,204; and 5,399,038. The disclosures of these patents are hereby expressly incorporated herein by reference.

Broadly speaking, the POS printer 100 is configured to print on both a paper 93 and/or a journal tape 106. To integrate the paper feed assembly 10 into the POS printer 100, the printer microprocessor 116 (FIG. 14) is programmed and is configured with a drive circuit 118 in the fashion discussed in the '620 patent, the '513 patent, and the '038 patent. This circuitry comprises logic which sends commands to the motor 12 to rotate which in turn causes the roller arm 18 to engage the paper 93 after the printer senses that there is paper in the chute 104. The logic may also include sequence, which tells the motor to continue turning until the paper is moved or fed into a print position and then retract the roller arm 18 after the paper has moved. In addition, the drive circuit 118 can be programmed to re-engage and move the paper 93 after the paper has been printed on so that the POS printer may be available for a new transaction.

It is understood that the printer 100 should be modified in a conventional manner to accept the paper feed assembly 10. This may simply be done by removing the two-driver device system and replacing it with the paper feed assembly 10. If needed, the printer 100 should further be modified so that the cage 14 on the paper feed assembly 10 can be secured onto the printer by fastening a pair of screws or fasteners to secure the cage to the printer.

Figure 14:
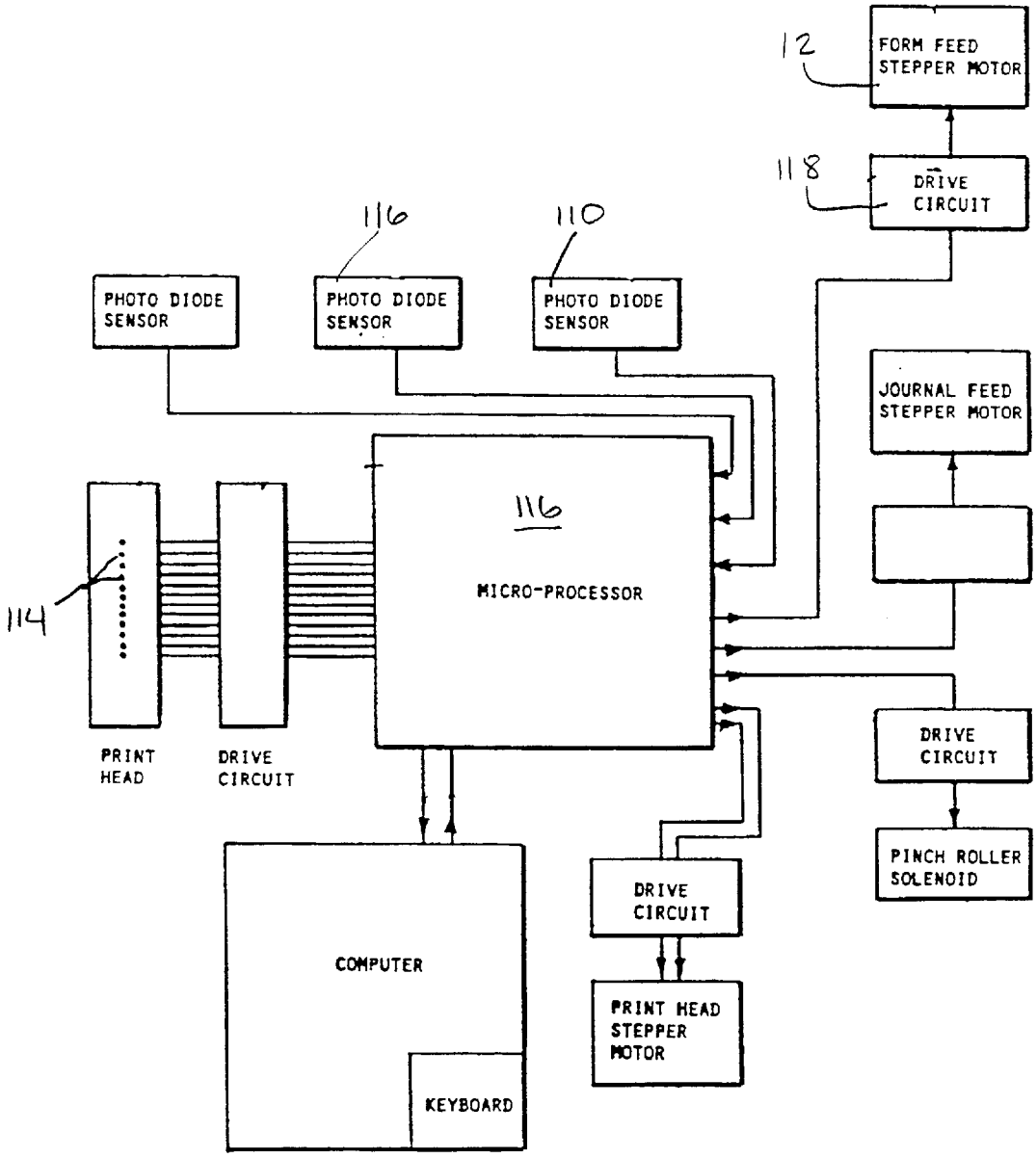
FIG. 14 is an exemplary circuitry provided in accordance with practice of the present invention.

With reference to FIGS. 12–14, the paper feed assembly 10 may be implemented to engage and feed the paper 93 by first inserting the paper into the print chute 104. A first sensor 110 (FIG. 13) detects the presence of the paper 93 which in turn prompts the printer microprocessor 116 to signal the drive circuit 118 to energize the paper feed assembly motor 12 (FIG. 14). As discussed above, the roller arm 18 turns in a first direction in response to the motor rotation and engages the paper 93 and feeds the paper to a pre-determined print position. This print position may, for example, be a position wherein the edge of the form is moved or fed just past the first sensor 110 to a print location 112 that is located adjacent the first sensor (FIG. 13). As readily understood, the print location 112 ensures that the form may be printed on by a print head 114 at or approximately the same position from one form to the next form. In other words, the same print position 112 facilitates print repeatability. Once the edge of the form 93 reaches the print location 112, a second signal may be sent from the drive circuit 118 to rotate the motor 10 in a second rotation. As previously discussed, this second rotation causes the roller arm 18 to retract.

The form 93 may now be printed on by the print head 114. After the form 93 has been printed on, a third signal may be sent from the drive circuit 118 to activate the paper feed assembly 10 to re-engage the printed form. This third signal may, for example, be used to move the form 93 past a second sensor 116 and into a basket (not shown) located adjacent the exit edge 118. When the paper 93 moves past the second sensor 116, this can prompt the drive circuit to send a fourth signal to retract the roller arm 18 to free up the chute 104 for a new form or for printing the same information on the journal tape 106.

Similar to the wall or print guide 92 previously discussed with reference to FIG. 4, the wall which provides the restraining or limiting function when the roller arm 18 engages the paper 93 is restraining wall or fence 120. This restraining wall 120 can have a variety of shape and can be made from a wide variety of materials, including hard plastic and metal and is conventional in the art.

Although the preferred embodiments of the invention have been described with some specificity, the description and drawings set forth herein are not intended to be delimiting, and persons of ordinary skill in the art will understand that various modifications may be made to the embodiments discussed herein without departing from the scope of the invention, and all such changes and modifications are intended to be encompassed within the appended claims. Various changes to paper feed assembly may be made including manufacturing the dimensions differently, using different materials, adding or changing the way the friction between the drive roller and the roller arm is generated, changing the way the two roller arm halves are assembled, changing from one to more than one tear drops on the receptacles and the bearings, and changing the working environment to a versatel machine for accepting deposits or for dispensing cash or for receiving cash or checks in a cash register. Accordingly, many alterations and modifications may be made by those having ordinary skill in the art without deviating from the spirit and scope of the invention.

What is claimed is:

1. A paper feed assembly comprising a motor, a roller arm, a gear train, and an assembly frame; said roller arm further comprising a drive roller, a driven roller, and a belt interconnecting the two rollers; wherein said motor has a first rotation which corresponds to a first signal input and a second rotation which corresponds to a second signal input; wherein said roller arm has a first travel direction and a second travel direction induced, at least in part, by the motor's first rotation and second rotation, wherein the drive roller has a first travel rotation and a second travel rotation induced, at least in part, by the motor's first rotation and second rotation, and wherein the assembly frame is configured for assembling the motor, the roller arm, and the gear train thereon.

2. The paper feed assembly of claim 1, wherein the gear train comprises a worm and a wormgear, said wormgear further comprises a wormgear shaft and wherein said roller arm is mechanically coupled to said wormgear shaft via the drive roller.

3. The paper feed assembly of claim 2, where said drive roller is rotated by said wormgear shaft and said driven roller is rotated by said belt.

4. The paper feed assembly of claim 1, wherein the roller arm has an upper roller aim half, a lower roller arm half, and a pivoting axis formed where the upper and the lower arm halves are joined together.

5. The paper feed assembly of claim 4, wherein the drive roller is mechanically coupled to a wormgear shaft via the driver roller and the driven roller is axially rotatable about the pivoting axis.

6. The paper feed assembly of claim 4, wherein the upper roller arm half and the lower roller arm half are joined together by aligning a pair of alignment bosses to a pair of alignment holes and by one of glue, rivet, welding, and fastener.

7. The paper feed assembly of claim 1, wherein the assembly frame is mounted in a POS printer and wherein the motor receives said first signal input and said second signal input from a drive circuit located on said POS printer.

8. The paper feed assembly of claim 7, wherein the POS printer further comprising a chute, a print head, and a paper print position, wherein the first travel direction moves the paper form to the print position and wherein the second travel direction moves the roller arm to a retracted position.

9. A paper feed assembly comprising a cage and mounted to the cage are a roller arm, a motor having a motor rotation, and a gear train for transferring the motor rotation to the roller arm from one position to a second position, said roller arm further comprising a drive roller, a driven roller and a belt, and wherein said two rollers and said belt are configured to rotate as a consequence of the motor rotation.

10. The paper feed assembly of claim 9, wherein the gear train comprises a worm and a wormgear, said wormgear further comprises a shaft and wherein said roller arm is fastened to said wormgear shaft via the drive roller.

11. The paper feed assembly of claim 9, wherein said belt is rotated by said drive roller and wherein said driven roller is rotated by the rotation of said belt.

12. The paper feed assembly of claim 9, wherein the roller arm has an upper roller arm half, a lower roller arm half, and a pivoting axis formed where the upper and lower arm halves are joined together.

13. The paper feed assembly of claim 12, wherein the upper roller arm half and the lower roller arm half are joined together by aligning a pair of alignment bosses to a pair of alignment holes and by one of glue, rivet, welding, and fastener.

14. The paper feed assembly of claim 9, wherein the cage is mounted in a POS printer and wherein the motor receives a first signal input and a second signal input from a drive circuit located on the POS printer.

15. The paper feed assembly of claim 14, wherein the POS printer further comprising a chute, a print head, and a paper print position, wherein said motor rotation comprises a first rotation and a second rotation, and wherein said motor first rotation rotates said roller arm in a first direction and said paper form to said paper print position, and said motor second rotation rotates said roller arm in a second direction, which is spaced apart from said paper form.

16. The paper feed assembly of claim 9, further comprising a second motor rotation, which is opposite to the motor rotation, and wherein the second motor rotation causes the roller arm, the drive roller, and the driven roller to rotate in reverse.

17. The paper feed assembly of claim 9, wherein the gear train is made from injection molding.

18. A method for moving a paper form into position for printing by a print head, said method comprising:

sending a first signal to a motor to turn a motor shaft in a first rotation, said motor shaft being coupled to a worm;

turning a wormgear with said worm, said wormgear comprising a wormgear shaft;

moving a roller arm in a first direction by action of the wormgear shaft; said roller arm comprising a drive roller, a drive roller, and a belt;

frictionally engaging a paper form by said belt and then rotating said belt in a first belt direction to thereby move the paper form into a paper print position; and sending a second signal to the motor to turn the motor shaft in a second rotation; said second rotation causing the roller arm to move in a second direction, and wherein said second direction causes the roller arm to be spaced apart from the paper form.

19. The method of claim 18, wherein the belt is anchored at a first end by the driven roller and at a second end by the drive roller.

20. The method of claim 18, further comprising the step of sending a third signal to the motor to turn the motor shaft in the first rotation and causing the belt to frictionally engage the paper form; rotating said belt in said first belt direction to thereby move the paper form away from a print chute; and sending a fourth signal to the step motor to turn the motor shaft in the second rotation.

* * * * *